US009334612B2

(12) United States Patent
Marshall et al.

(10) Patent No.: US 9,334,612 B2
(45) Date of Patent: May 10, 2016

(54) CONTROL LEVER ASSEMBLY FOR WALK-BEHIND COMPACTION ROLLER

(71) Applicant: Wacker Neuson Production Americas LLC, Menomonee Falls, WI (US)

(72) Inventors: Michael D. Marshall, Muskego, WI (US); Arber Halimi, Hartland, WI (US)

(73) Assignee: Wacker Neuson Production Americas LLC, Menomonee Falls, WI (US)

( * ) Notice: Subject to any disclaimer, the term of this patent is extended or adjusted under 35 U.S.C. 154(b) by 44 days.

(21) Appl. No.: 14/504,505

(22) Filed: Oct. 2, 2014

(65) Prior Publication Data

US 2015/0098761 A1 Apr. 9, 2015

Related U.S. Application Data

(60) Provisional application No. 61/886,780, filed on Oct. 4, 2013.

(51) Int. Cl.

| | |
|---|---|
| ***E01C 19/00*** | (2006.01) |
| ***E01C 19/26*** | (2006.01) |
| ***G05G 13/00*** | (2006.01) |

(52) U.S. Cl.

CPC ..... *E01C 19/262* (2013.01); *G05G 13/00* (2013.01); *Y10T 29/49826* (2015.01); *Y10T 74/20268* (2015.01); *Y10T 74/20396* (2015.01)

(58) Field of Classification Search

CPC E01C 19/262; G05G 13/00; Y10T 74/20268; Y10T 74/20396; Y10T 29/49826

USPC ..... 404/117, 122, 131

See application file for complete search history.

(56) References Cited

U.S. PATENT DOCUMENTS

| | | | | |
|---|---|---|---|---|
| 1,676,941 | A * | 7/1928 | Cantu | A01B 29/02 172/350 |
| 3,147,818 | A * | 9/1964 | Howard | B60K 28/14 172/42 |
| 4,361,201 | A | 11/1982 | Hallstedt et al. | |
| 4,573,543 | A * | 3/1986 | Bataille | B62D 51/002 180/19.1 |

(Continued)

FOREIGN PATENT DOCUMENTS

| | | | |
|---|---|---|---|
| CN | 100465382 | C | 3/2009 |
| DE | 4129915 | A1 | 10/1992 |

(Continued)

OTHER PUBLICATIONS

Extended European Search Report dated Apr. 21, 2015: Application No. 14187779.5-1604—(6) pages.

(Continued)

*Primary Examiner* — Raymond W Addie
(74) *Attorney, Agent, or Firm* — Boyle Fredrickson, S.C.

(57) ABSTRACT

A control lever assembly and methods of forming and using a control lever assembly of a compaction roller are disclosed. A control lever assembly includes a lever that is defined by a body having a first end connectable to a control arm of a compaction roller. The body forms a first grip site and a second grip site that are each offset from the first end of the body. The first grip site and the second grip site are laterally offset from a longitudinal center-line axis of the control arm and spaced from one another so that each of the first grip site and the second grip site are beyond the reach of a hand engaged with the other of the first grip site and the second grip site.

20 Claims, 17 Drawing Sheets

(56) References Cited

U.S. PATENT DOCUMENTS

| | | | | |
|---|---|---|---|---|
| 4,799,398 | A | 1/1989 | Asano | |
| 4,911,575 | A * | 3/1990 | Tidwell | E04F 21/24 16/426 |
| 5,297,379 | A * | 3/1994 | Smith | A01D 34/68 180/19.1 |
| 6,302,620 | B1 * | 10/2001 | Mutsuji | E01C 19/283 404/117 |
| 6,382,383 | B1 | 5/2002 | Schennach | |
| 7,194,929 | B2 | 3/2007 | von Werder | |
| 7,416,365 | B2 * | 8/2008 | Mochigi | E01C 19/23 404/117 |
| 2013/0170908 | A1 * | 7/2013 | Lindley | E01C 19/43 404/117 |

FOREIGN PATENT DOCUMENTS

| | | | |
|---|---|---|---|
| EP | 0593063 | A1 | 4/1994 |
| FR | 2355122 | A1 | 1/1978 |
| WO | 99/37862 | A1 | 7/1999 |

OTHER PUBLICATIONS

Ammann—Vibratory-Double-Drum-Roller—ARW65: International Distribution Partners: www.ammann-group.com: Dated Apr. 2012—6 pages.

* cited by examiner

CONTROL LEVER ASSEMBLY FOR WALK-BEHIND COMPACTION ROLLER

CROSS-REFERENCE TO RELATED APPLICATIONS

This application claims priority to U.S. Provisional Patent Application Ser. No. 61/886,780 filed on Oct. 4, 2013 titled "Control Lever Assembly For Walk-Behind Compaction Roller" and the disclosure of which is expressly incorporated herein.

BACKGROUND OF THE INVENTION

Walk-behind compaction rollers are used to compact soil and asphalt in order to provide a firm foundation for structural building, to reduce future settlement of soil, or to compact asphalt for pathway, road, and parking lot construction. Such machines are commonly controlled by a single operator who follows behind the machine to direct the machine's travel direction and actuate its vibration control(s). Commonly, a control arm extends rearwardly from the machine and provides the mechanical advantage to allow the operator to physically manipulate the direction of travel of the machine. Such machines may have one drum (single-rum) or two (dual-drum) drums acting as compaction surface(s).

One method to control the speed and direction (forward and/or rearward) of such machines is with a control lever that is supported at a rearward end portion of the control arm and whose position relative to the control arm actuates forward and reverse self-propelled travel of the machine. As alluded to above, such machines can be steered with a lateral force applied to the control arm to effectuate turning of the machine.

Commonly, when the control lever is released, a spring force returns the control lever into the neutral position, and the machine ceases all travel. Such machines are also commonly provided with a button or plunger that is disposed on a rearward distal end of the control arm and which interacts with the control associated with manipulation of the control lever. Depression of the button from behind the machine can suspend travel of the rolling machine altogether or at least prevent rearward propulsion of the machine while permitting forward propulsion. Such a configuration prevents an operator from being pinned between the machine and an obstacle behind the machine.

These machines are relatively heavy, making turning of the machine difficult. As mentioned above, the length of the control arm is set to obtain leverage sufficient to allow a single operator to turn the machine by imparting lateral directional forces of a manageable magnitude to the control arm.

In addition to the physical interaction of the operator with the control arm and the control lever, desired operation of the compaction roller requires the operator be able to readily visually inspect the operating environment to assess the speed and direction of travel relative to, for instance, areas already compacted, obstructions such as trench walls, other personnel, equipment, grade stakes or markings, already set formwork, etc. Because the rearward orientation of the control arm and control lever places the operator in a position that is substantially directly behind the compaction roller, the compaction roller can substantially hinder the operator's ability to visually inspect the operating environment.

Many prior manually operated compaction milers are provided with a single control handle on the control arm that is oriented along the centerline or in-plane with the machine's centerline. One such configuration is shown in FIG. 24, in which a visible area is denoted by lines 30 relative to the underlying compaction roller 32. Such a configuration requires the operator to frequently reposition his body relative to the control arm 34 and the control lever 36 in order to achieve a desired orientation required to visually inspect the longitudinal edges 38 that extend along generally opposite lateral sides of the underlying compaction roller 32. In confined work environments, cornering and edge following can result in the operator attaining positions relative to the control arm 34 and control lever 36 that detracts from the operator's overall ability to manipulate the compaction roller 32 to effectuate the desired turning and travel direction control of the compaction roller.

The position and orientation of the control lever relative to the control arm of many manually steered compaction rollers are ill-suited to allow the operator to attain various operating positions relative to the control arm and the control lever to provide the desired physical interaction with both the control arm and the control lever. They also provide for only limited positional association of the operator relative to the control arm to improve the visibility associated with operation of the compaction roller while maintaining a desired interaction of the operator with the control arm and the control lever. That is, the operators of such devices must commonly shuffle their left and right hands into and out of interaction with the control lever and/or the control arm or control handles to achieve the desired visibility and operator physical positioning with respect to the compaction roller controls to achieve the desired changes to the operating status and direction of travel of the compaction roller.

There is therefore a need for an improved arrangement for controlling operation of manually steered compaction roller machines from various positions relative to the control lever and control arm.

SUMMARY OF THE INVENTION

The present invention provides compaction roller control assemblies and methods of forming and using a control lever assembly of a compaction roller that solves one or more of the drawbacks mentioned above. A first aspect of the invention discloses a control lever assembly that includes a lever that is defined by a body and which is operable from alternate lateral positions associated with the direction of travel of the compaction roller.

Another aspect of the invention discloses a control lever assembly of a compaction roller wherein the control lever assembly includes a body having a first end connectable to a control arm of a compaction roller. The control lever assembly includes a first grip site and a second grip site that are formed by the body and offset from the first end of the body. The first grip site and the second grip site are laterally offset from a longitudinal center-line axis of the control arm and spaced from one another so that one of the first grip site and the second grip site is beyond reach of a hand engaged with the other of the first grip site and the second grip site.

A further aspect of the invention that is usable with one or more of the above aspects discloses a control assembly of a walk-behind compaction roller. The control assembly includes a first control handle and a second control handle that are each rigidly connected to a control arm that is configured to extend in a rearward direction from a compaction roller. A control lever is connected to the control arm and movable relative thereto to manipulate a travel speed of the compaction roller. A first grip site and a second grip site are defined by the control lever and oriented such that the first grip site and the second grip site are laterally offset from one another and shaped to slidably cooperate with a respective one of the first control handle and the second control handle so that an operator can simultaneously grip at least one of 1) the first grip site and the first control handle or 2) the second grip site and the second control handle.

Another aspect of the invention that is combinable with one or more of the above aspects discloses a method of forming a control arrangement for a walk behind compaction roller. A control lever is provided which defines a first grip site and a second grip site that are laterally offset from another. The control lever is connectable to a control arm that is constructed to extend rearward from a compaction roller. A first control handle and a second control handle are connected to the control arm so that the first control handle is proximate the first grip site and the second control handle is proximate the second grip site and the first and second control handles are oriented on opposite lateral sides of the control arm.

A further aspect this is useable with one or more of the above aspects discloses a method of controlling a walk behind compaction roller that has at least one rotating drum, a frame supported on the drum, and a control arm extending rearwardly from the frame. The method of controlling the walk behind compaction roller includes moving a control lever that defines a first grip site and a second grip site that are laterally offset from opposite sides of a longitudinal centerline of the control arm to control forward and rearward travel of the compaction roller. The method further includes concurrently grasping at least one of 1) the first grip site and a first control handle and 2) the second grip site and a second control handle to maintain a desired orientation of the control lever relative to the control arm. A lateral force can be imparted to the control arm to turn the compaction roller via grasping of at least one of the first control handle and the second control handle.

Various other features, aspects, embodiments and alternatives of the present invention will be made apparent from the following detailed description taken together with the accompanying drawings. It should be understood, however, that the detailed description and specific examples, while indicating preferred embodiments of the invention, are given by way of illustration and not limitation. Many changes and modifications could be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings, in which like reference numerals represent like parts throughout, and in which.

DETAILED DESCRIPTION OF THE PREFERRED EMBODIMENTS

Figure 21:
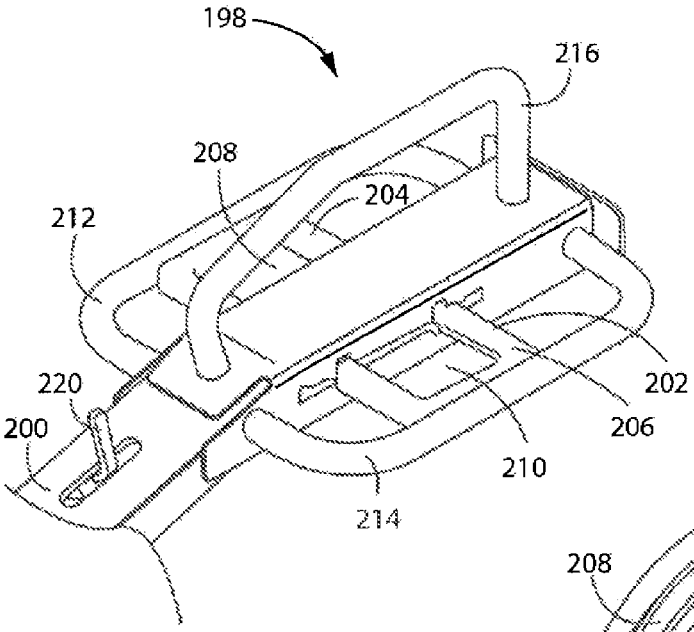
FIG. 21 is a view similar to FIG. 6 of an operator control assembly according to another embodiment of the present invention.
Figure 22:
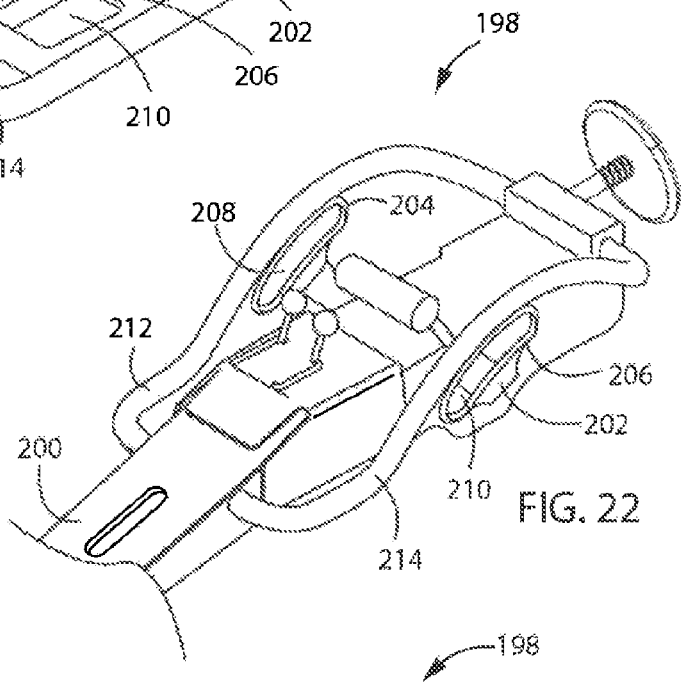
FIG. 22 is a view similar to FIG. 21 of an operator control assembly according to another embodiment of the present invention.
Figure 23:
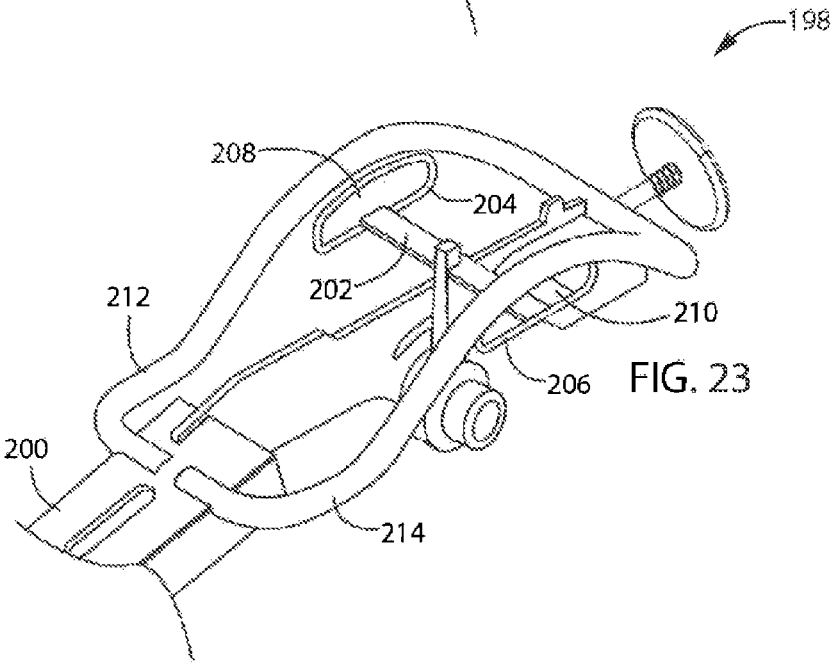
FIG. 23 is a view similar to FIG. 21 of an operator control assembly according to another embodiment of the present invention.

The present invention discloses a number of control lever assemblies according to different embodiments of the invention that each overcome one or more of the drawbacks discussed above. FIGS. 1-20 are various views of a control arrangement of a manually steered compaction roller according to one embodiment of the invention. FIGS. 21-23 show alternate embodiments of the invention that achieve the same benefits as disclosed with respect to the following description of FIGS. 1-20. The various embodiments are encompassed by the scope of the appended claims.

Figure 1:
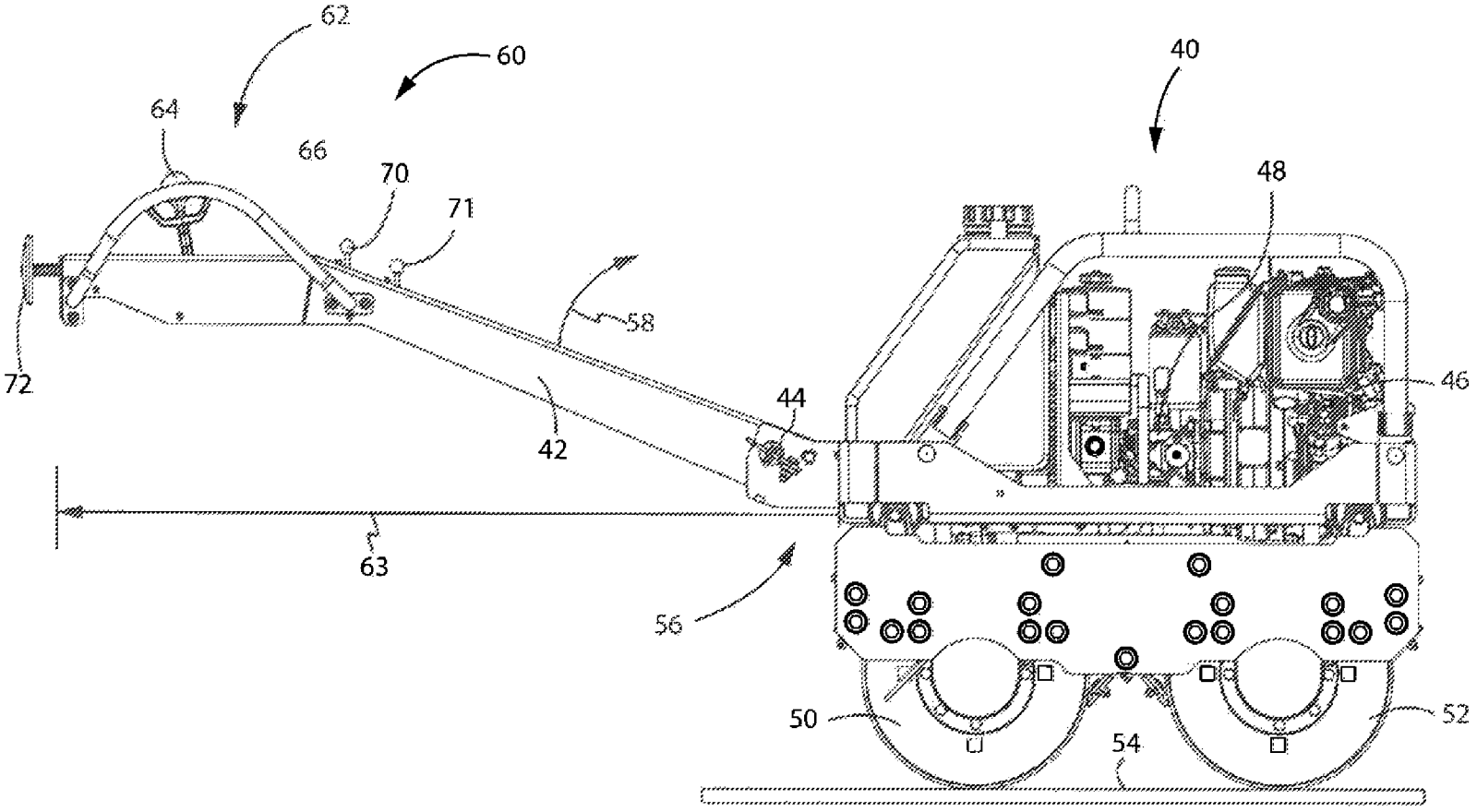
FIG. 1 is a side elevation view of a walk-behind vibratory compaction roller machine having an operator control assembly according to one embodiment of the present invention.
Figure 2:
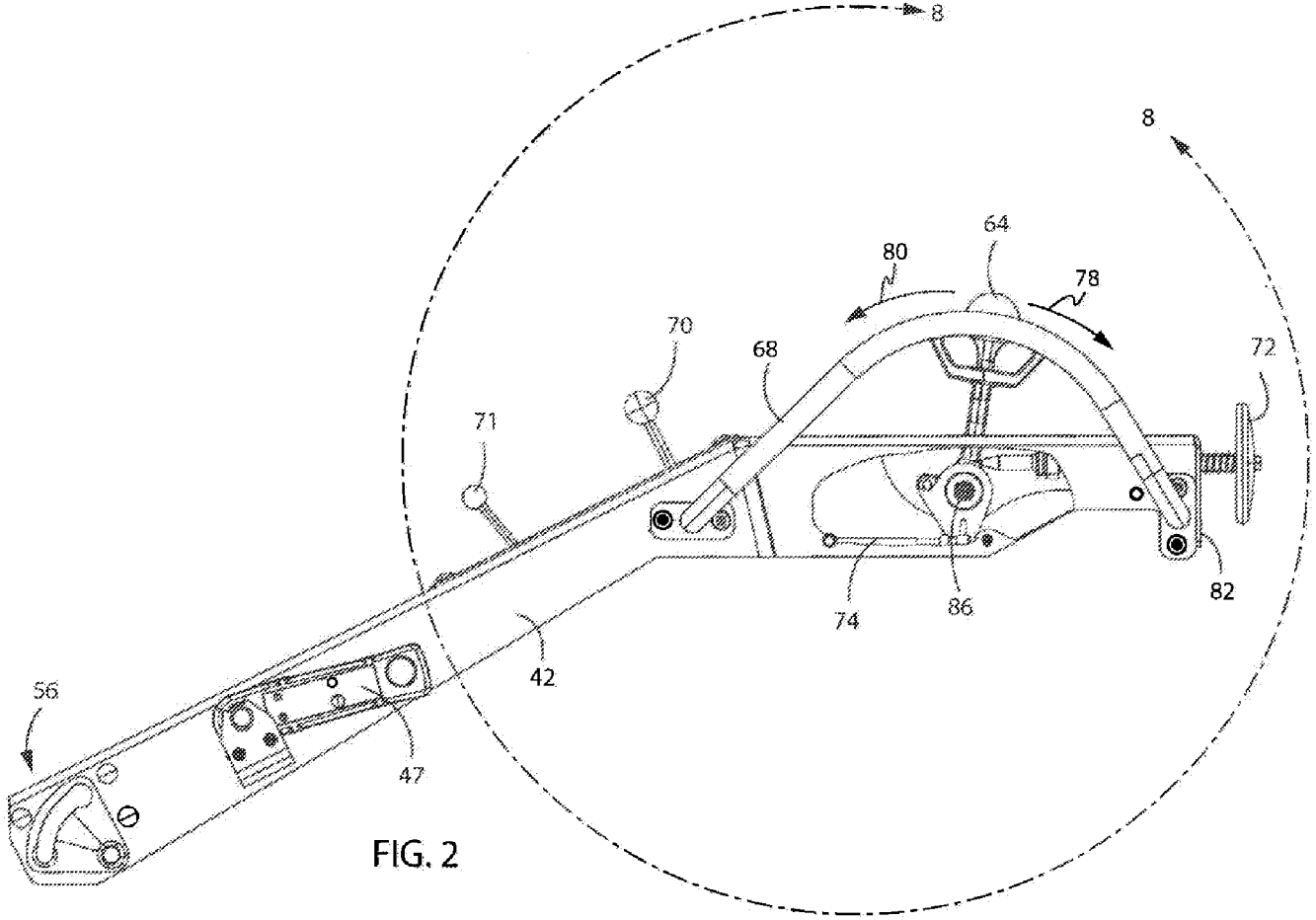
FIG. 2 is a side elevation view of the operator control assembly removed from the compaction roller shown in FIG. 1.
Figure 5:
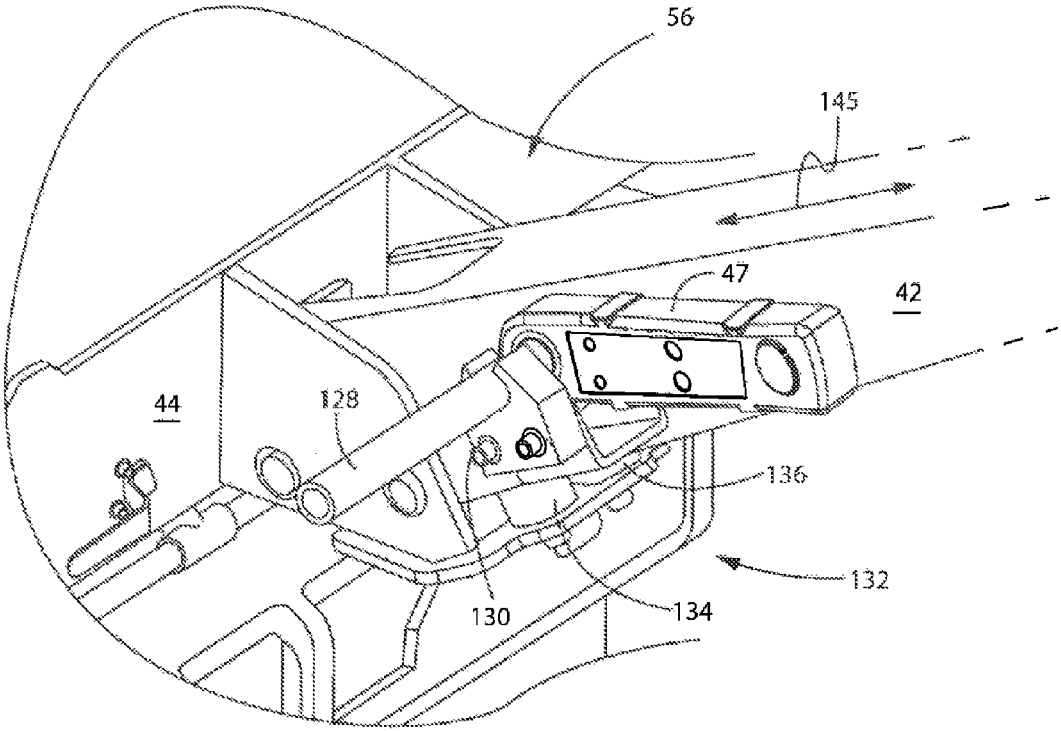
FIG. 5 is a partial isometric view of a pivotable connection between the operator control assembly and the compaction roller as shown in FIG. 1.
Figure 6:
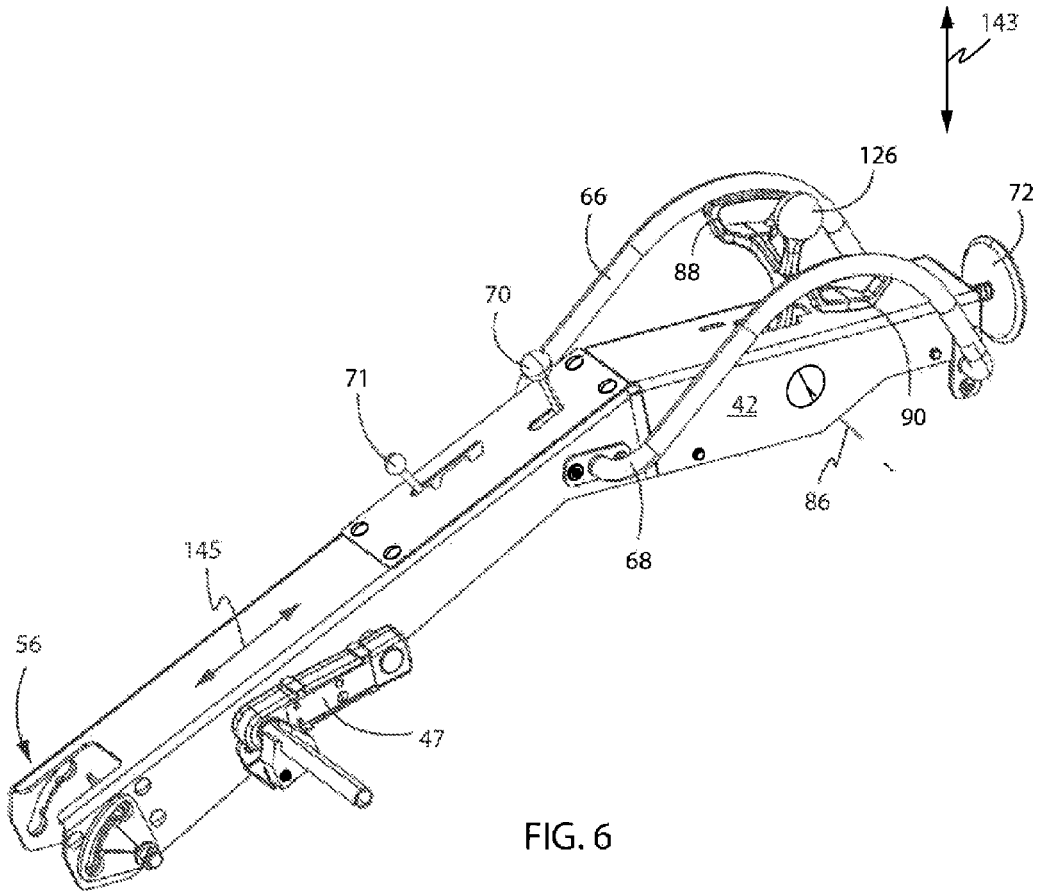
FIG. 6 is a front isometric view of the operator control assembly shown in FIG. 2.
Figure 7:
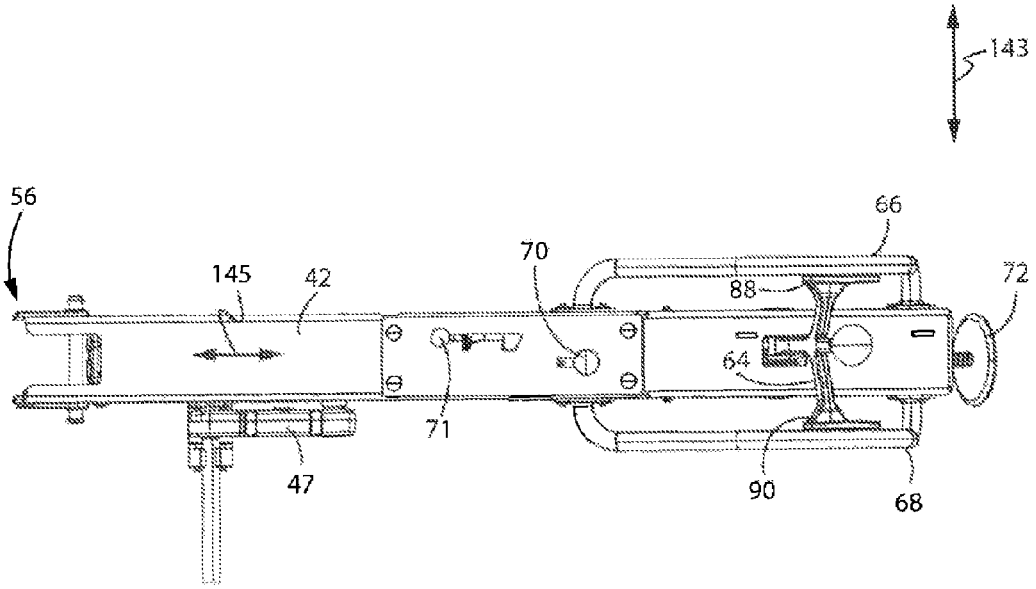
FIG. 7 is a top plan view of the operator control assembly shown in FIG. 6.
Figure 8:
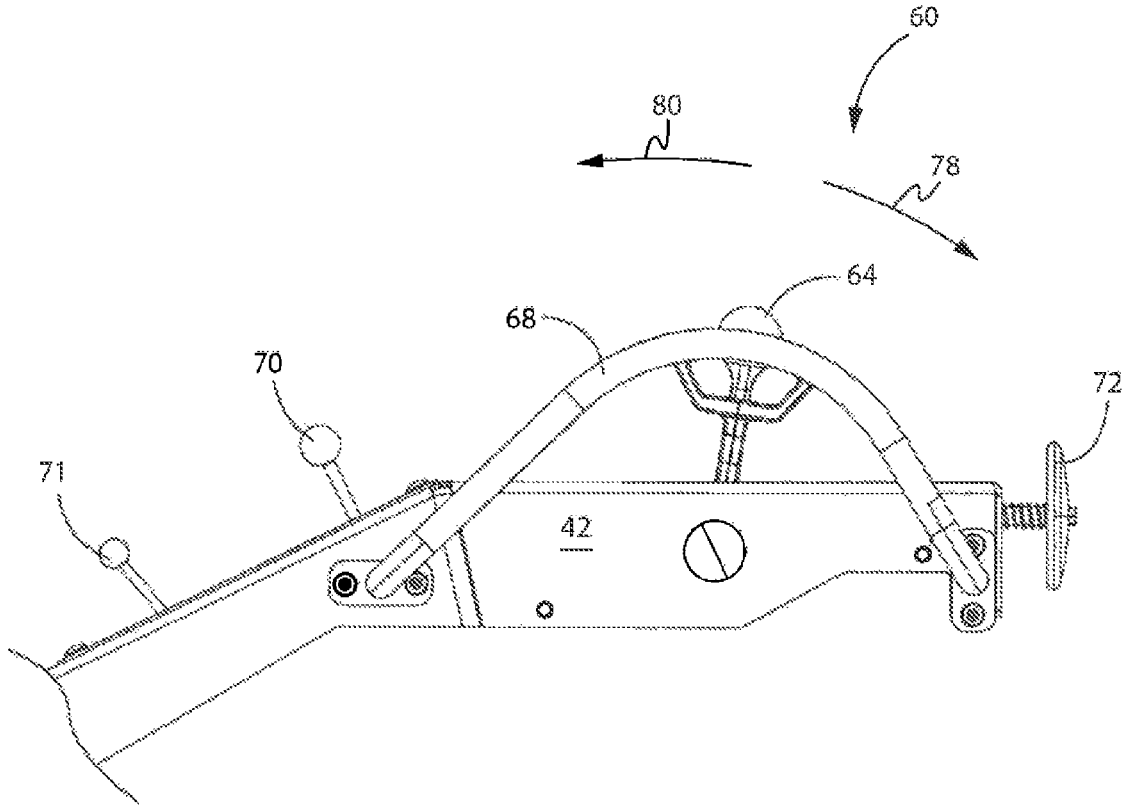
FIG. 8 is a side elevation detail view of the operator control assembly taken along line 8-8 shown in FIG. 2.
Figure 9:
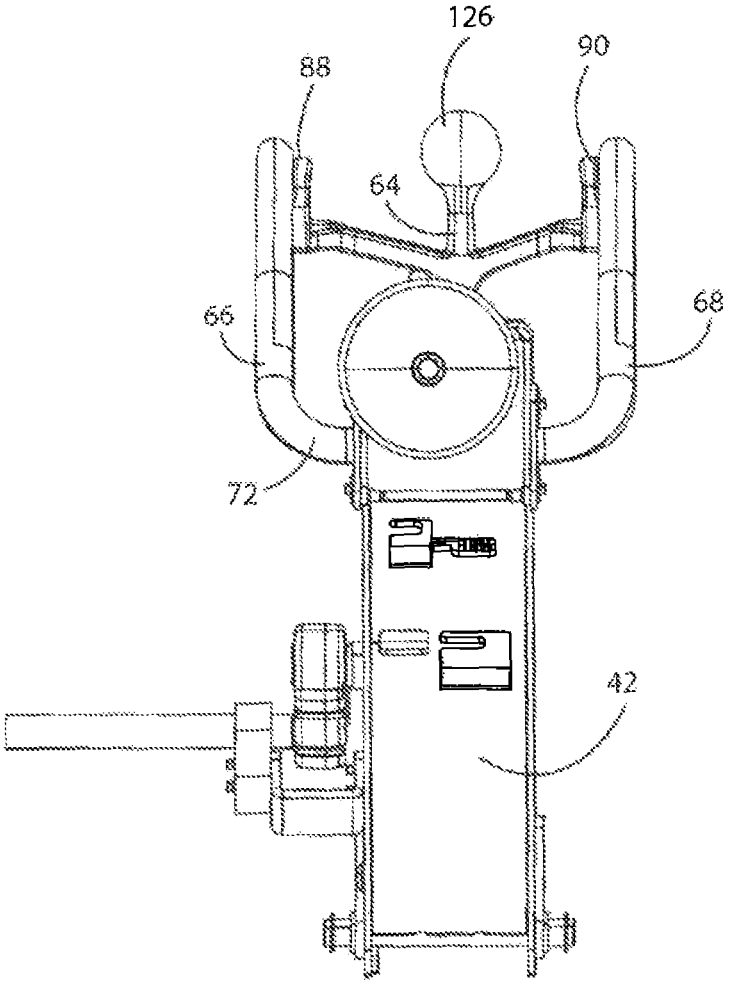
FIG. 9 is a rear elevation view of the operator control assembly shown in FIG. 2.
Figure 10:
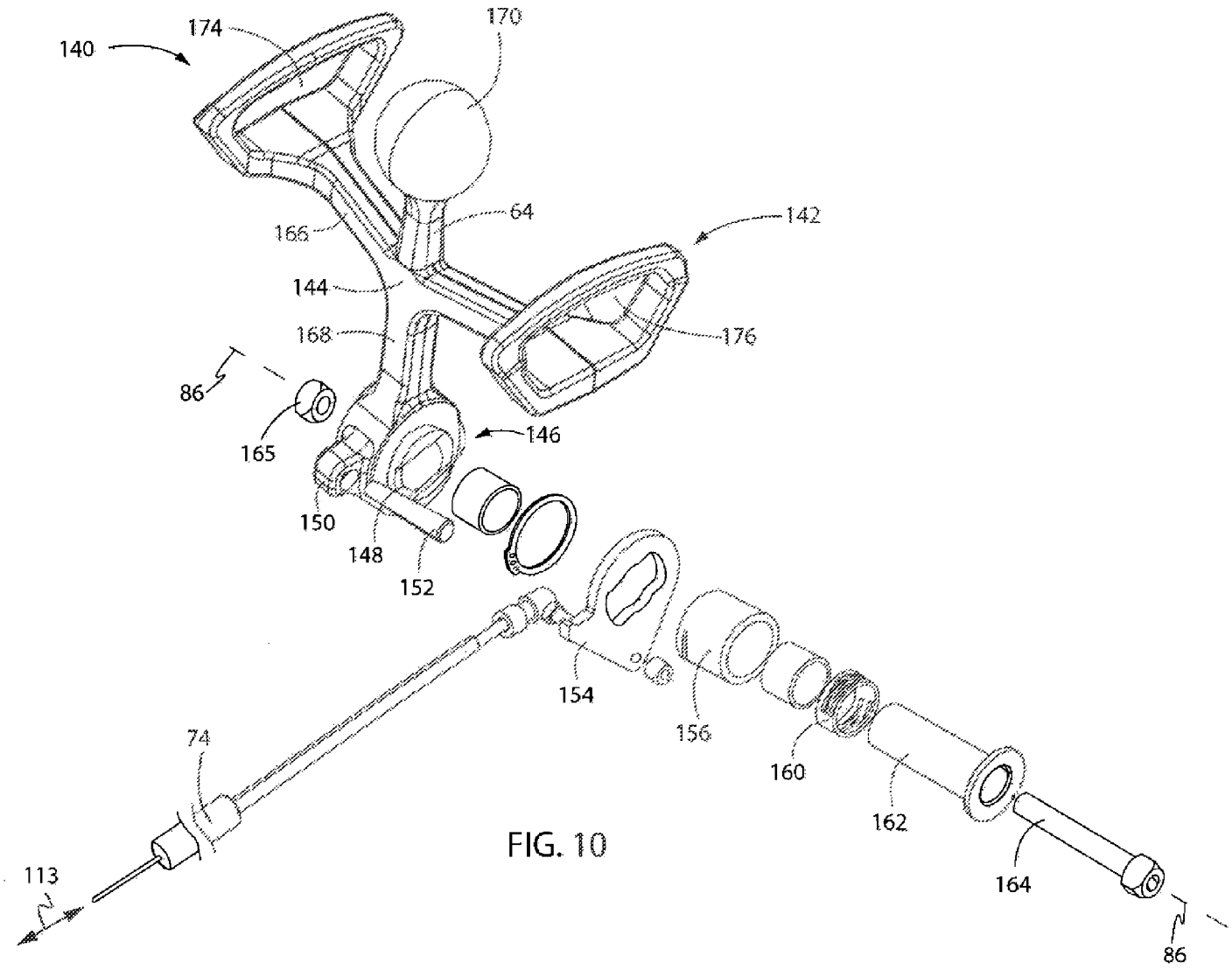
FIG. 10 is an exploded isometric view of a control lever assembly removed from the operator control assembly shown in FIG. 2.
Figure 11:
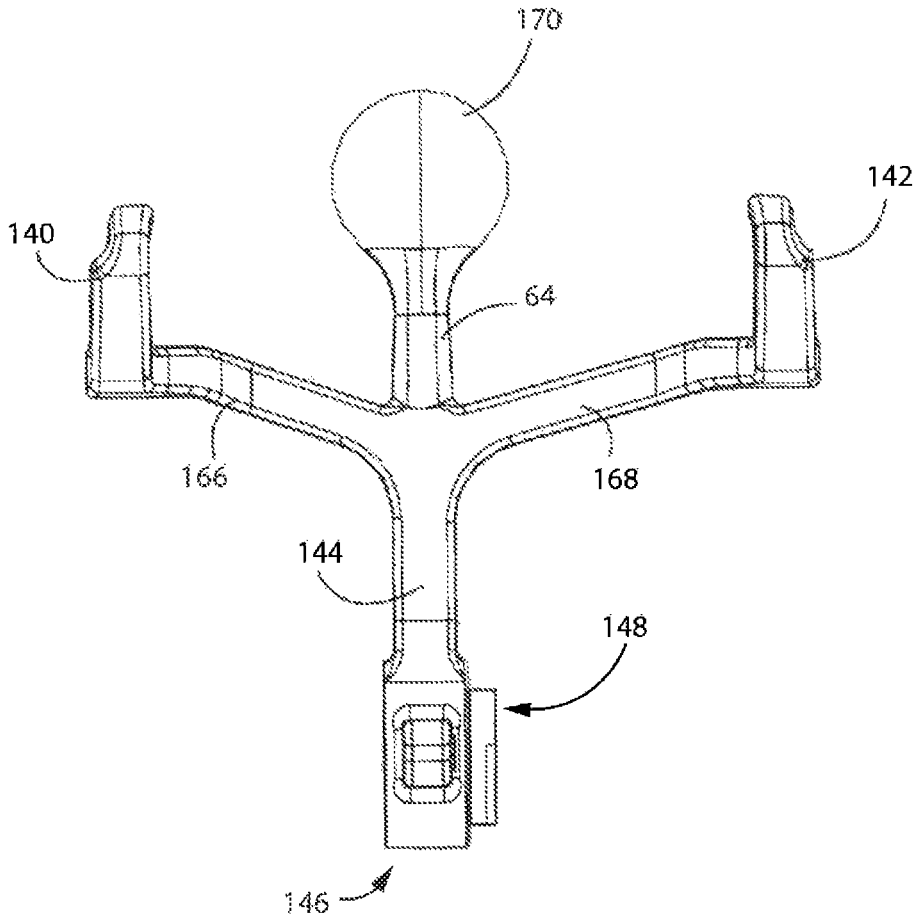
FIG. 11 is a front elevation view of a control lever of the control lever assembly shown in FIG. 10.
Figure 12:
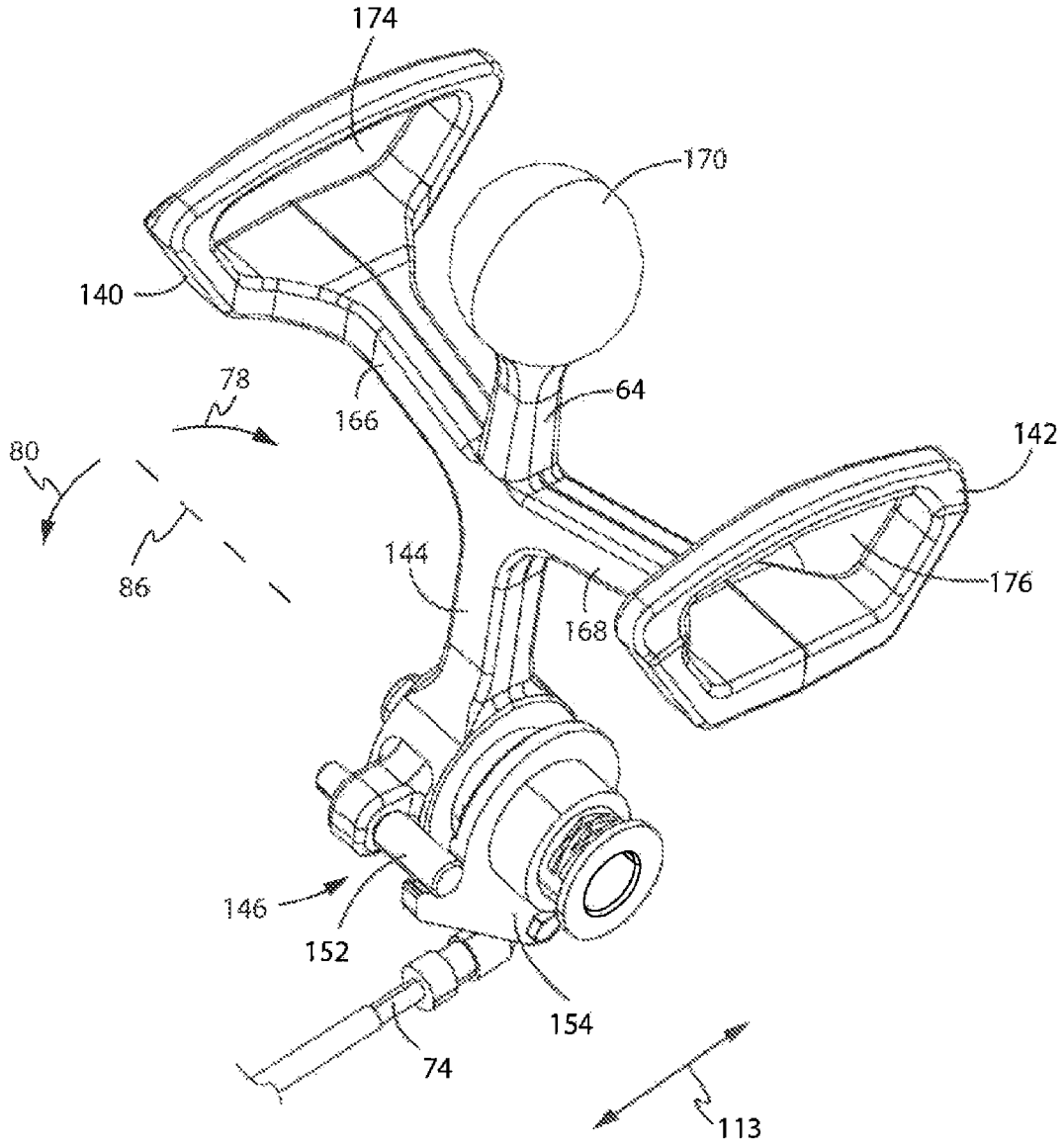
FIG. 12 is an assembled isometric view of the control lever assembly shown in FIG. 10.

FIG. 1 shows a compaction roller 40 having a control arm 42 that may be pivotably and/or removably connected to a frame 44 of the compaction roller 40. Compaction roller 40 includes an engine 46 and a hydraulic system 48 associated therewith. Engine 46 can be provided in various configurations such as electric start, pull start, and crank start configurations. When provided in a crank start configuration, compaction roller 40 is provided with a crank handle 47 (FIG. 2. FIG. 5) configured to be removably associated with a crankshaft associated with engine 46 for initiating the first combustion compression cycle and thereby manual starting of engine 46. Crank handle 47 removably cooperates with control arm 42 such that the orientation shown in FIG. 2 is associated with a storage position of crank handle 47 relative to compaction rollers 40 equipped with a crank start feature. Understandably, crank handle 47 need not be provided with compaction rollers having electric start and/or recoil start engine configurations.

A first drum 50 and a second drum 52 of compaction roller 40 are supported by frame 44 and constructed to compact the ground surface 54 associated with movement of compaction roller 40. One or both of drums 50, 52 can be directly or indirectly excitable so as to enhance the compaction performance associated with operation of compaction roller 40. For example, an eccentric weight may be located on a lower portion of frame 44 between the two drums 50 to vibrate both drums 50 and 52. In this case, the upper portion of the frame may be vibrationally isolated from the lower portion by shock mounts or the like. At least one drum, and possibly both, is bi-directionally drivable to propel the compaction roller back and forth or in a forward and a rearward direction relative to the supporting ground surface.

A pivot assembly 56 pivotably connects control arm 42 to frame 44 such that control arm 42 can be pivoted about a horizontal axis between an in-use orientation, as shown in FIG. 1, in which the control arm 42 extends generally rearward from frame 44 and a storage or transport orientation, indicated by arrow 58, for reducing the footprint associated with compaction roller 40 when not in use. It is further appreciated that control arm 42 can be secured in one or both of the in-use and storage or transport orientations. In a preferred embodiment, control arm 42 can be secured in the storage orientation but freely movable from the in-use orientation toward the storage orientation. It is appreciated that such configurations can include one or more catch arrangements that can be manipulated by the user to change the orientation of control arm 42 relative to frame 44 of compaction roller 40.

Referring to FIGS. 1 and 2, a control or an operator area 60 of compaction roller 40 is defined in the vicinity of a rearward portion 62 of control arm 42 and offsets an operator in a rearward longitudinal length or distance, indicated by dimension 63, relative to roller 40. Although an exemplary dimension or distance 63 is shown in the drawings, it is appreciated that the length of control arm 42 can be selected to improve the mechanical advantage associated with manual turning during operation of compaction roller 40. It is appreciated that a greater distance between compaction roller 40 and operator area 60 will increase the mechanical advantage associated with control arm 42, whereas shorter distances will require the operator to impart greater forces to control arm 42 to yield comparable turning performance than associated with longer control arms. It is further appreciated that control arm 42 can be pivotably connected to compaction roller 40 to be settable at various elevations to accommodate operators of different heights and/or provide different positions of the operator area 60 to suit different operator preferences—such as the control area being positioned at a hip height or rib height as different operators may prefer or different operational situations may require.

Referring to FIGS. 1-9, operator area 60 includes a control lever assembly or control lever 64; one or more control handles 66, 68; and can include one or more of an exciter control or exciter control assembly 70; a throttle control or throttle control assembly 71, and a plunger or button 72. Referring to FIGS. 1, 2, 6 and 7, alternate ends of control handles 66, 68 are rigidly connected to control arm 42 whereas control lever 64 is pivotably or otherwise movably connected thereto such that control lever 64 is movable relative to both control arm 42 and control handles 66, 68. As disclosed further below, control handles 66, 68 provide for a rigid interaction of the user with control arm 42 during operation of compaction roller 40.

As shown in FIG. 2, control lever 64 cooperates with a push-pull cable 74 associated with generating forward and rearward linear operation of compaction roller 40 as a function of the orientation of control lever 64 relative to control arm 42. Preferably, control lever 64 is biased to a neutral position associated with suspending propulsion of compaction roller 40 in either the forward or the rearward directions. It is appreciated that push-pull cable 74, or any other suitable linkage, can be provided in any of a number of suitable configurations for communicating instructions associated with the orientation of control lever 64 to the underlying compaction roller 40. It is further appreciated that push-pull cable 74 and/or the control lever 64 can be configured to manipulate any of a number of operational systems, such as a hydraulic system or an electrical system associated with generating the desired forward, rearward, and neutral or non-moving operation of compaction roller 40. It is further appreciated that control lever 64 and/or the push-pull cable 74 can be configured to interact with various systems, such as relays, valves, etc., associated with generating the desired manipulation of the underlying operation of compaction roller 40.

In a preferred embodiment, one or more of exciter control 70 and engine controls, such as a throttle control 71, and/or button 72 are positioned on control arm 42 proximate operator area 60 such that a user or operator engaged with control lever 64 can interact with and control operation of the engine and/or the exciter associated with operation of compaction roller 40. It is appreciated that the exciter control 70 and throttle control 71 can be configured to maintain a desired operation of the respective exciter and/or throttle associated with the underlying engine 46 without sustained operator interaction with the respective exciter control 70 and/or throttle control 71. It is further appreciated that, like control lever 64, exciter control 70 and/or throttle control 71 be provided with a push-pull cable, elongated connector, gears, transmission, fluid system, relays, valves, etc. and/or an electrical system to effectuate communication of the exciter operation instructions and/or discrete throttle control instructions from operator area 60 to the respective underlying exciter and throttle systems of roller 40. In a preferred embodiment, exciter control 70 is positioned nearer push button 72 than throttle control 71 as many users prefer to more commonly adjust operation of the exciter assembly than manipulate the throttle position during operation of compaction roller 40. Preferably, each of exciter control 70 and throttle control 71 are configured to be manipulated by a single hand of a user such that the desired orientation of control lever 64 can be maintained even during adjustment of exciter control 70 or throttle control 71.

From the orientation shown in FIG. 2, it should be understood that rearward or clockwise movement of control lever 64 from a neutral position, toward a distal end 82 of control arm 42, as indicated by arrow 78, effectuates rearward travel of compaction roller 40. Conversely, forward or counter-clockwise movement of control lever 64, as indicated by arrow 80, effectuates forward operation of compaction roller 40. In the illustrated embodiment, control lever 64 rotates about a pivot axis 86, thereby manipulating the orientation of cable 74 to achieve the desired change in the operating condition of compaction roller 40. The control lever 64 is directly or indirectly biased to its neutral position such as, for example, by a spring acting on a pump control lever (not shown) to which the cable 74 is connected so that forward/rearward operation of compaction roller 40 is suspended whenever the operator releases control lever 64. The push-pull cable 74 preferably is coupled to the hydraulic pump or other propulsion system of the compaction roller 40 such that the compaction roller 40 is propelled at a speed that is generally proportional to the extent of movement of the control lever 64 relative to its the neutral position.

Figure 3:
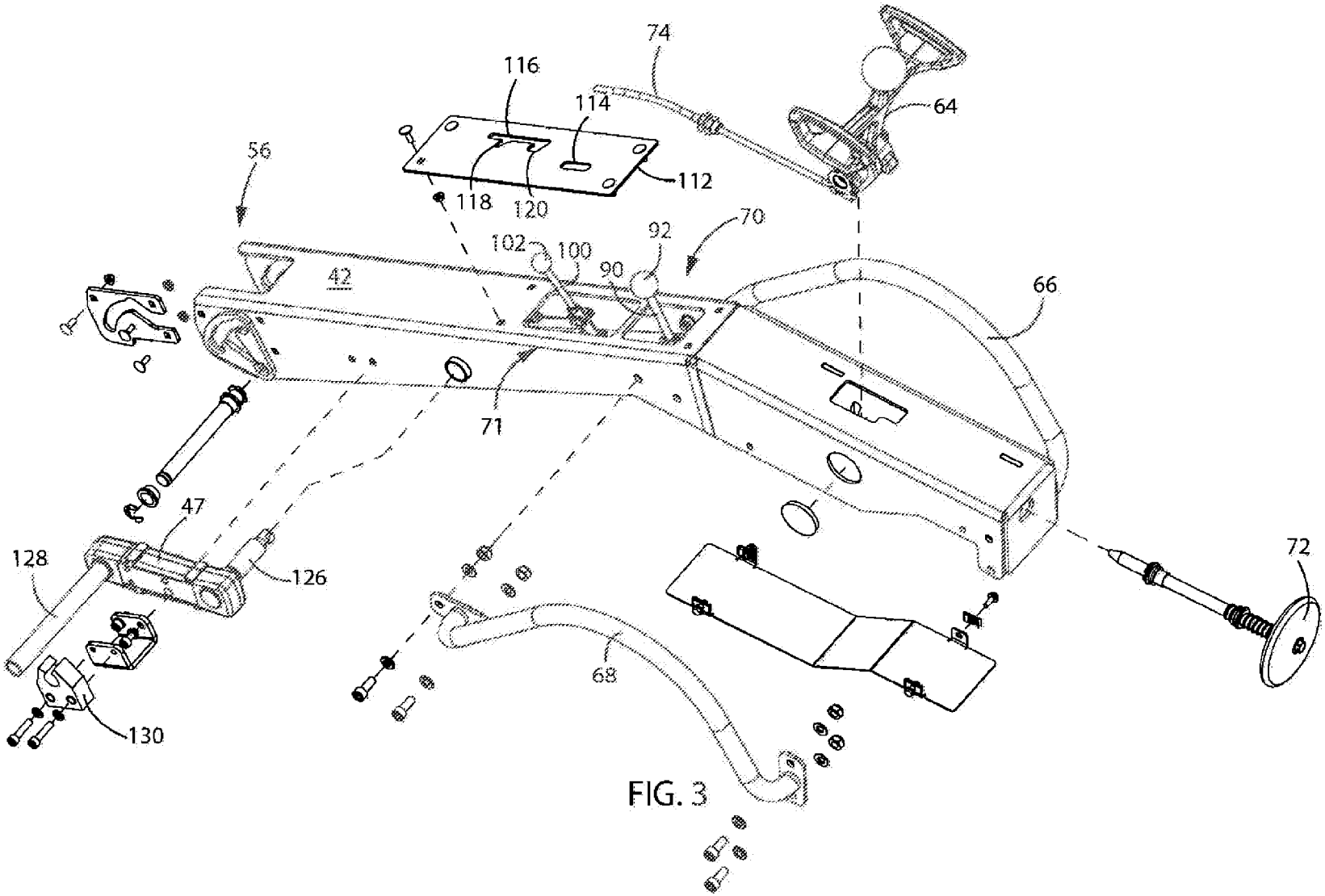
FIG. 3 is a partially exploded isometric view of the operator control assembly shown in FIG. 1.
Figure 4:
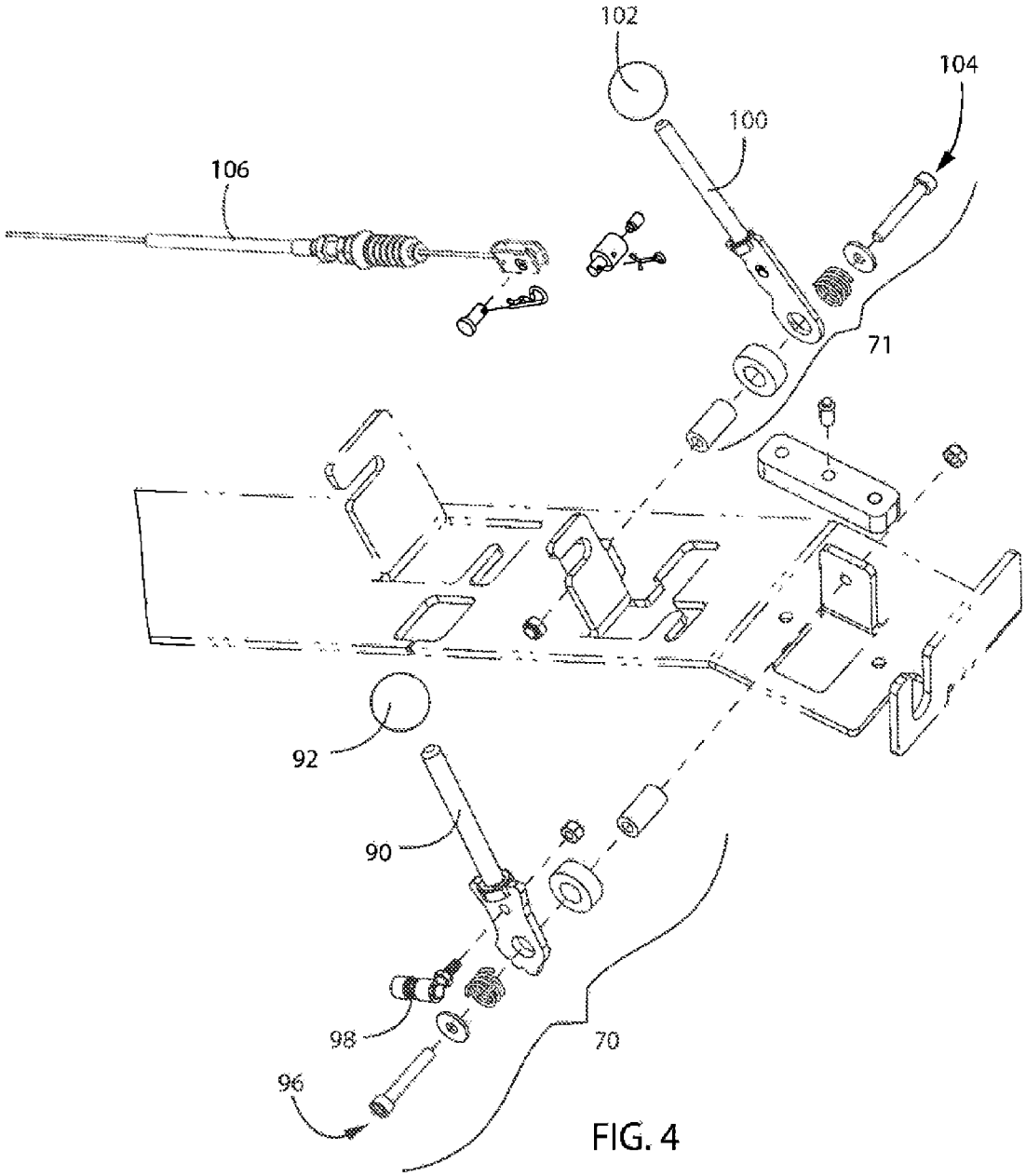
FIG. 4 is an exploded isometric view of a throttle control assembly and an exciter control assembly removed from the operator control assembly shown in FIG. 3.

Referring to FIGS. 3 and 4, exciter control 70 includes a stem 90 having a ball 92 attached to an end thereof. A flange 94 is secured to control arm 42 and is constructed to support exciter stem 90 relative thereto. A pivot assembly 96 pivotably connects exciter stem 90 relative to flange 94. A push/pull cable 98 is connected to exciter stem 90 offset from the axis associated with pivot assembly 96 such that cable 98 communicates exciter operation instructions from operator area 60 to the exciter associated with compaction roller 40. Throttle control 71 includes a throttle control stem 100 having a ball 102 connected at an end thereof. A pivot assembly 104 pivotably connects throttle control stem 100 to flange 94. A push/pull cable 106 is connected to throttle control stem 100 at a location offset from the axis of rotation associated with pivot assembly 104 such that movement of throttle control stem 100 relative to control arm 42 manipulates the throttle condition and thereby the engine speed associated with operation of compaction roller 40.

Referring to FIG. 3, exciter control stem 90 and throttle control stem 100 are constructed to pass through one or more openings 108, 110 defined by control arm 42. A faceplate 112 cooperates with control arm 42, exciter control stem 90, and throttle control stem 100 so as to generally overlie openings 108, 110 defined by control arm 42. Faceplate 112 includes a first elongated opening 114 that slidably cooperates with exciter control stem 90 and a second elongated opening 116 that slidably cooperates with throttle control stem 100. Opening 116 of faceplate 112 can include one or more catches 118, 120 associated with maintaining a desired orientation of throttle control stem 100 relative to faceplate 112. It should be appreciated that when throttle control stem 100 is associated with a respective catch 118, 120, such cooperation maintains throttle control stem 100 in the desired orientation with respect to a desired configuration of the engine throttle assembly and thereby maintains a desired engine speed associated with operation of compaction roller 40. It is further appreciated that opening 114 associated with exciter control 70 could include similar such catches. Balls 92, 102 associated with the respective exciter control stem 90 and throttle control stem 100 removably cooperate with the respective control stem such that faceplate 112 can be secured to control arm 42 in close slidable cooperation with exciter control stem 90 and throttle control stem 100.

Referring to FIGS. 3 and 5, control arm 42 includes an opening 124 that slidably cooperates with a crank handle stem 125 associated with crank handle 47. Crank handle 47 includes a handle 128 that snap fittingly cooperates with a catch 130 such that crank handle 47 can be securely supported by control arm 42 when not in use. As shown in FIG. 5, a shock arrangement 132 that includes one or more bushings 134, 136 that are disposed between frame 44 and control arm 42. Understandably, bushings 134, 136 can be secured to one of frame 44 of compaction roller 40 or control arm 42 and configured to engage the other of frame 44 or control arm 42 when control arm 42 is oriented in the in-use position. Bushings 134, 136 help to mitigate communication of vibration associated with operation of compaction roller 40 and/or the exciter associated therewith along control arm 42 toward the user associated with operator area 60.

Referring to FIGS. 3 and 6-9, control lever 64 includes a first grab or grip site 140 and a second grab or second grip site 142 that are offset in opposite lateral directions, indicated by arrow 143, relative to a longitudinal axis or center-line, indicated by arrow 145, of control arm 42. Control handle 66 and control handle 68 have generally arcuate shapes that allow grip sites 140, 142 to be maintained in close proximity to the respective grip handle 66, 68 throughout the range of pivotable translation of control lever 64 about pivot axis 86. Preferably, grip handles 66, 68 are curved relative to both the vertical and horizontal planes that correlate to rotation of control lever 64. The larger curvature of handles 66, 68, i.e., the curvature oriented in a generally vertical plane, is between about five inches and nine inches in radius or more preferably about seven inches in radius. The more horizontal curvature of handles 66, 68 are between one and four inches in radius and preferably in about a two inch radius. Preferably, the rearward and forward curvatures are selected to provide comfortable ergonomic interaction, such as 30-40 degrees of wrist rotation, associated with orientation of the hand(s) of the operator for various operating positions relative to the control arm 42. It is appreciated that other ranges of radii can be provided as a function of the lateral thickness of control arm 42, the range of motion of control lever 64, and/or to provide desired ergonomic interaction with handles 66, 68 for various lateral and rearward positions of the operator relative to the distal end 82 of control arm 42.

Each such configuration allows an operator to grasp a respective portion of the respective control handles 66, 68 and/or a respective grip site 140, 142 throughout the movable range of control lever 64 and relative to the opposite lateral sides of control arm 42. As explained further below, such a construction allows the operator to position himself at locations further outboard of the longitudinal axis 145 of control arm 42 than would otherwise be possible while maintaining secure interaction with control lever 64 and at least one of control handles 66, 68. Control lever 64 and control handles 66, 68 thus allow an operator to securely grasp at least one of control handles 66, 68 of compaction roller 40, even during manipulation of control lever 64 and/or interaction with exciter control 70 and/or throttle control 71 to maintain a desired operation and direction of travel of roller 40 even when located at various positions relative to control arm 42.

Control handles 66, 68 are also rigidly constructed to tolerate the lateral loading of control arm 42 during turning operations and are maintained in close proximity to grip sites 140, 142 to allow a user to bias control arm 42 in lateral directions without imparting the lateral loading forces to control lever 64.

Referring to FIGS. 3 and 6-12, control lever 64 includes a body 144 having a first end 146 that defines an opening 148 associated with supporting control lever 64 about pivot axis 86 relative to control arm 42. First end 146 includes a boss 150 that is shaped to cooperate with a pin 152 oriented to engage a tang 154 that is positionally associated with body 144. Tang 154 is operationally connected to cable 74 to effectuate generally longitudinal displacement, indicated by arrow 113, of the cable to effect speed and directional control associated with the forward and rearward travel of compaction roller 40. A collar 156 and a spring 160 slidably cooperate with a shaft 162 that receives a fastener 164 having a nut 165 and that rotationally or pivotably secures control lever 64 to the control arm 42.

Body 144 of control lever 64 could be formed as one piece or as an assembly of two or more interconnected components. The illustrated body is formed of one piece and may be formed, for example, through metal casting or injection molding, although other methods of manufacture are envisioned. Body 144 includes a first stem 166 associated with first grip site 140 and a second stem 168 associated with second grip site 142. An optional third grip site or knob 170 extends in a generally upward direction between first grip site 140 and second grip site 142 of control lever 64. Stem 166 associated with grip site 140 is shaped to define a hand or finger window 174, and stem 168 has a generally mirror image to define a similarly shaped hand or finger window 176 associated with grip site 142. Grip site 140 and finger window 174 are shaped to allow the hand of an operator to cooperate therewith in either of an underhand or an overhand grip orientation. Second grip site 142 and finger window 176 are similarly constructed. The generally close proximity of grip site 140, 142 relative to a respective one of control handles 66, 68 allows the operator to use either hand to grab or grasp a respective grip site 140, 142 and the corresponding control handle 66, 68 with a substantially closed-handed orientation in either an overhand or underhand orientation.

It is appreciated that the orientation of the user's hand relative to the respective grip site will vary during operation of roller 40 as the operator moves from left-hand to right-hand lateral side positions relative to control arm 42 and/or to a more rearward orientation relative to button 72 during operation of compaction roller 40. The generally mirror construction of grip sites 140, 142, the close proximity of grip sites 140, 142 to a respective control handle 66, 68, and the availability of multiple control handle and control lever interaction locations allow the operator to quickly switch from one-handed to two-handed operation without unduly interfering with the other hand of the operator and/or interrupting operation of roller 40.

Referring back to FIGS. 2 and 6, the construction and position of control handles 66, 68 and grip sites 140, 142 allow an operator positioned generally behind button 72 to engage one or more of the first grip site 140 and control handle 66, the second grip site 142 and control handle 68, and/or control lever knob 126 to maintain a desired orientation of control lever 64 relative to control arm 42 in order to effectuate the desired forward and/or rearward operation of compaction roller 40 from a generally ergonomically comfortable position. An operator positioned rearward of button 72 could most comfortably interact in a generally overhand interaction, like gripping the handlebars of a bicycle, with either of first grip site 140 and control handle 66, second grip site 142 and control handle 68 and/or control knob 126 in which the thumbs of the user generally face toward centerline 95 of control arm 42 when engaged with the respective grip site 140, 142.

Figure 24:
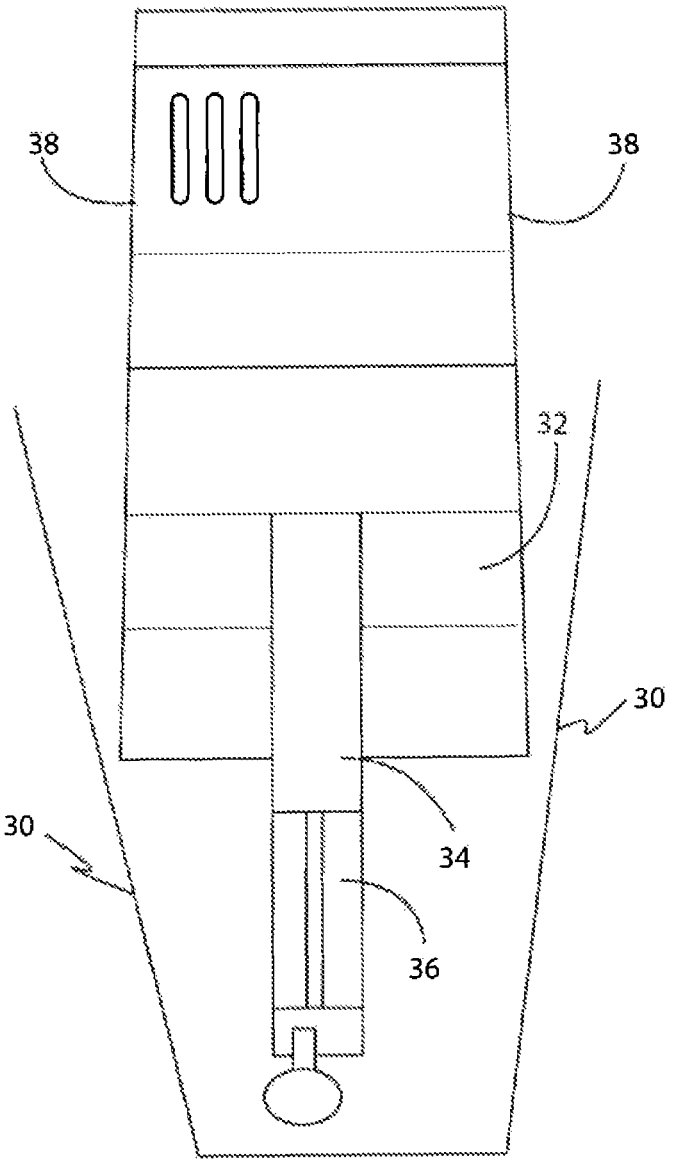
FIG. 24 is a graphic representation showing a compaction roller and the alternate lateral side sight lines available to an operator associated with the operator control assembly of such devices.

For more aggressive turning operations that cannot be easily effectuated while standing directly behind the control arm 42, the operator can stand beside control arm 42 while maintaining engagement with one or more of grip site 140, 142 and/or knob 126. Achieving such an orientation improves the operator's ability to view a respective lateral edge 38 (FIG. 24) of compaction roller 40. It also allows the operator to orient himself in a manner that improves his leverage when turning the compaction roller 40. That is, operating the compaction roller from beside the control arm 42 rather than from directly behind it allows the operator to better use his mass rather than simply the strength of his arms and torso to effectuate the steering operation.

Figure 13:
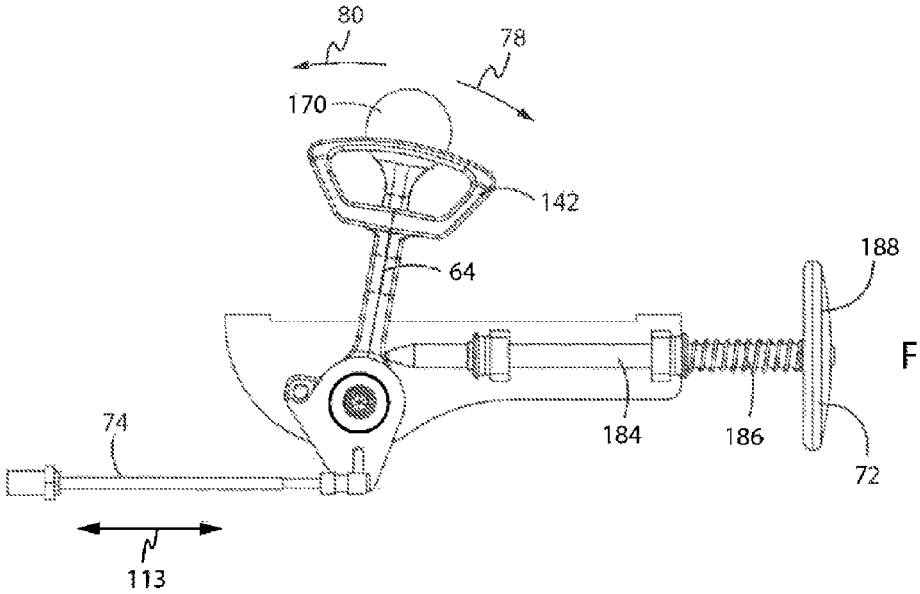
FIG. 13 is a side elevation view of the control lever assembly shown in FIG. 12 associated with a plunger assembly of the operator control assembly shown in FIG. 2 wherein the plunger assembly is in a non-actuated position.
Figure 14:
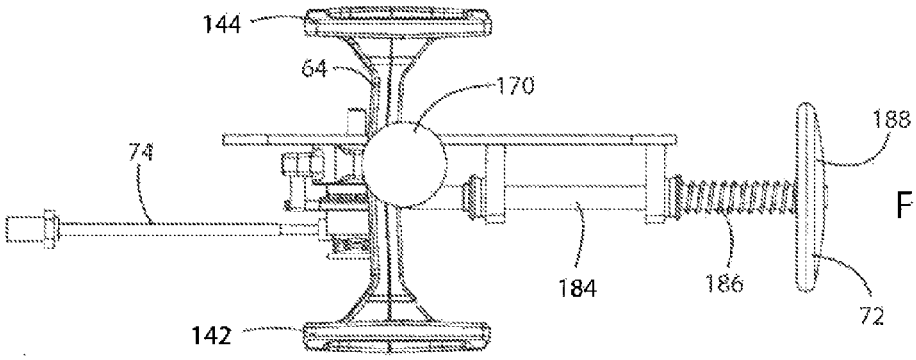
FIG. 14 is a top plan view of the control lever and plunger assembly shown in FIG. 13.
Figure 15:
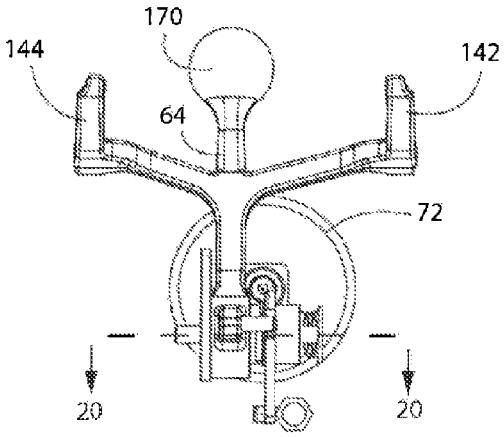
FIG. 15 is a front elevation view of the control lever and plunger assembly shown in FIG. 13.
Figure 16:
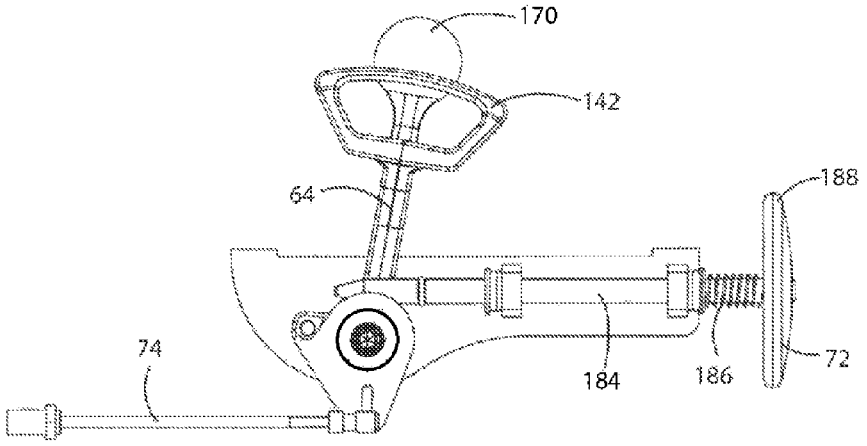
FIG. 16 is a view similar to FIG. 13 with the plunger assembly in an actuated position relative to the control lever assembly.
Figure 17:
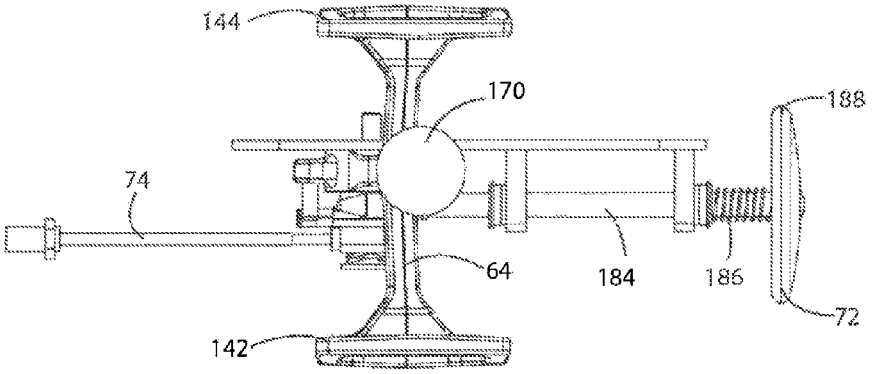
FIG. 17 is a view similar to FIG. 14 of the control lever and plunger assemblies in the relative orientations shown in FIG. 16.
Figure 18:
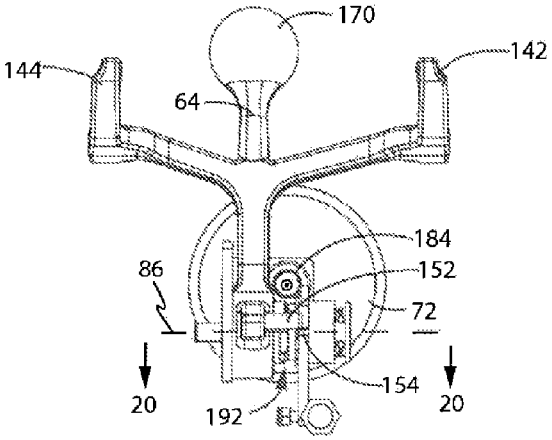
FIG. 18 is a view similar to FIG. 15 of the control lever and plunger assemblies in the relative orientations shown in FIG. 16.
Figure 19:
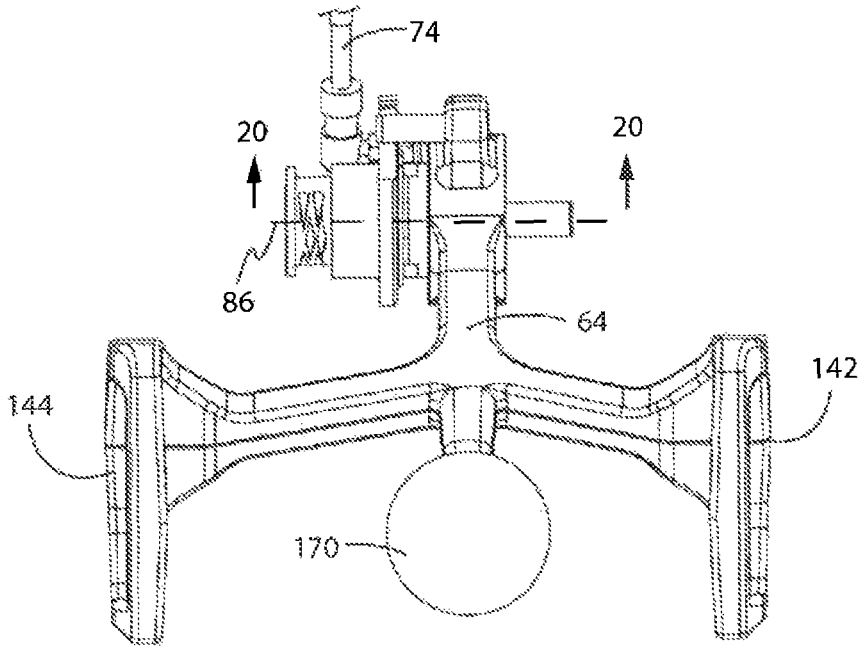
FIG. 19 is a top plan view of the control lever and plunger assemblies in the relative orientations shown in FIG. 16.
Figure 20:
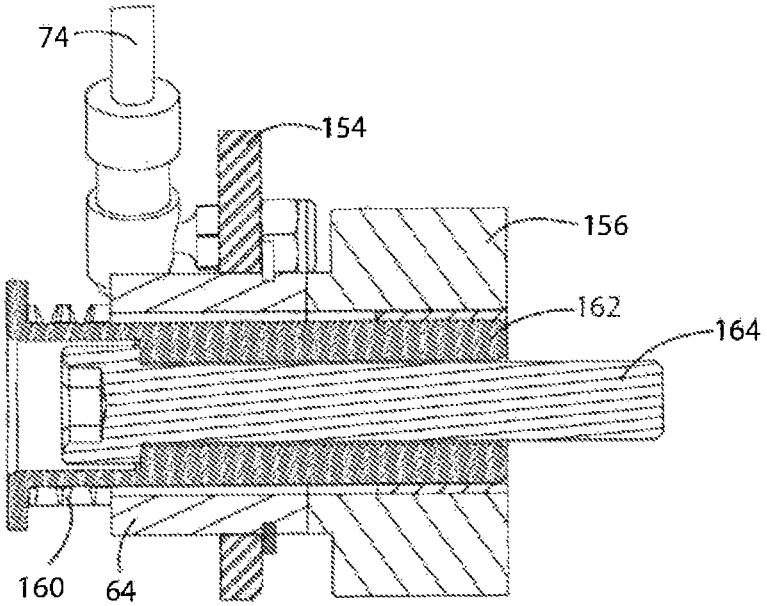
FIG. 20 is a cross section view of a pivot assembly of the control lever assembly shown in FIG. 19 taken along line 20-20 shown in FIGS. 15 and 18.

Referring to FIGS. 3 and 13-20, button 72 includes a stem or shaft 184 that is constructed to selectively interfere with rearward operation of compaction roller 40. Referring to FIGS. 13-15, a spring 186 biases shaft 184 and an actuator 188 associated with button 72 in a generally rearward direction relative to control lever 64. When it is not actuated, button 72 does not interfere with manipulation of control lever 64 in either its forward or rearward directions. Referring to FIGS. 3 and 16-18, manipulation or actuation of actuator 188 in a generally forward direction relative to control lever 64, such as by contact with the operator, shifts shaft 184 in a forward longitudinal direction such that shaft 184 interferes with the operational interaction between control lever 64 and the cable 74. Interference of shaft 184 with control lever 64 creates a gap 192 (FIG. 18) between control lever 64 and tang 154. Gap 192 decouples rearward movement of control lever 64 from manipulation of tang 154 but maintains an operative engagement between pin 152 and tang 154 such that forward motion of control lever 64 about pivot axis 86 achieves forward operation of compaction roller 40. Said another way, actuation of button 72 suspends further rearward propulsion of compaction roller 40 but maintains the ability of control lever 64 to achieve forward propulsion of compaction roller 40. A further description of the construction and operation of button 72 and the interference of the same with respect to manipulation of control lever 64 can be found in U.S. Pat. No. 6,382,383, the entire disclosure of which is incorporated herein.

FIGS. 21-23 show various control lever assemblies for manually steerable compaction rollers according to alternate embodiments the present invention. Referring generally thereto, each control lever assembly 198 includes a control arm 200 that is constructed to be pivotably or fixedly connected to a manually steered compaction roller. Each assembly includes a control lever 202 that is movably connected to a respective control arm 200 and which defines first and second grip sites 204, 206. Each grip site 204, 206 also preferably defines a respective grip or finger window 208, 210. Each control lever 202 movably cooperates with the control arm 200 such that at least a portion of each respective grip site 204, 206 is maintained in close proximity to a respective control handle 212, 214 that is rigidly connected to a respective control arm 200 such that lateral turning forces imparted to the respective control arm 200 by an operator are passed to the control arm 200 through the control handle 212, 214 rather than the respective control lever 202.

From the embodiment shown in FIG. 21, it should be appreciated that control lever 202 can be constructed to generally slidably cooperate with the distal end portion of control arm 200 whereas the configuration shown in FIGS. 22 and 23 show alternate embodiments of control lever 202 that are pivotably connected to the respective control arm 200 in a manner similar to control lever 64 as described above. Referring back to FIG. 21, it should further be appreciated that one or more of the control assemblies shown in Figs. can include additional control handles 216 that are not otherwise positionally associated with a respective portion of the corresponding control lever 202.

It is further appreciated that one or more of the control lever assemblies shown in FIGS. 21-23 can also include one or more control levers 202 that are supported by the respective control arm 200 at a location proximate the respective control lever assembly. Control levers 202 can be configured to manipulate and/or maintain operation of a throttle and/or an exciter assembly associated with a respective compaction roller to which the respective control lever assembly is engaged. Such a consideration allows an operator engaged with the respective control lever assembly to control one or both of the engine speed and/or exciter operation from a location wherein the operator can maintain a desired engagement with the respective control lever assembly associated with forward and rearward travel of the compaction roller.

Regardless of the method of mobility, whether slidable, rotational, or pivotable, each control lever and control handle arrangement disclosed herein includes a plurality of grip sites that allow an operator to concurrently interact with and maintain the orientation of the respective control lever relative to the underlying control arm. The handles are rigidly connected to the corresponding control arm to accommodate the lateral forces communicated to the respective control arm, whether by pushing or pulling operations, to effectuate the desired manual steering operation. Each control lever and handle arrangement permits these controls in a manner that generally isolates the corresponding control lever from supporting such lateral forces. The close proximity of each control lever relative to the corresponding control arm allows the operator to maintain a desired position relative to the control arm as the operator shifts from various orientations relative to the alternate lateral sides of the control arm and positions generally more rearward thereof to achieve the desired operation and desired direction of travel of the compaction roller.

Although the best mode contemplated by the inventors of carrying out the present invention is disclosed above, practice of the present invention is not limited thereto. It will be manifest that various additions, modifications and rearrangements of the aspects and features of the present invention may be made in addition to those described above without deviating from the spirit and scope of the underlying inventive concept. The scope of some of these changes is discussed above. The scope of other changes to the described embodiments that fall within the present invention but that are not specifically discussed above will become apparent from the drawings and the appended claims.

We claim:

1. A control lever assembly of a compaction roller, the control lever assembly comprising:

a body having a first end connectable to a control arm of a compaction roller, and a first grip site and a second grip site formed by the body and offset from the first end of the body, the first grip site and the second grip site being laterally offset from a longitudinal center-line axis of the control arm and spaced from one another so that one of the first grip site and the second grip site is beyond reach of a hand engaged with the other of the first grip site and the second grip site; and first and second control handles rigidly connected to the control arm and disposed outboard of a respective one of the first grip site and the second grip site so that a user can concurrently grip one of the first and second control handles and the respective one of the first grip site and the second grip site.

2. The control lever assembly of claim 1 further comprising a third grip site defined by the body and positioned laterally between the first grip site and the second grip site.

3. The control lever assembly of claim 1 further comprising a tang disposed proximate the first end of the body and constructed to engage a push-pull cable.

4. The control lever assembly of claim 1 wherein the body is pivotably connected to the control arm.

5. A control assembly of a walk-behind compaction roller, the control assembly comprising:

a first control handle and a second control handle that are each rigidly connected to a control arm configured to extend in a rearward direction from a compaction roller;

a control lever connected to the control arm and movable relative thereto to manipulate a travel speed of the compaction roller; and a first grip site and a second grip site defined by the control lever, the first grip site and the second grip site laterally offset from one another and shaped to slidably cooperate with a respective one of the first control handle and the second control handle so that an operator can simultaneously grip either 1) the first grip site and the first control handle or 2) the second grip site and the second control handle.

6. The control assembly of claim 5 further comprising a third grip site defined by the control lever and disposed laterally between the first grip site and the second grip site.

7. The control lever assembly of claim 6 wherein the third grip site is a control knob.

8. The control lever assembly of claim 5 wherein the control lever is pivotably connected to the control arm to define an arc of motion of the first grip site and the second grip site.

9. The control lever assembly of claim 8 wherein the first control handle and the second control handle each have an arcuate shape that is similar to an are of motion of the first grip site and the second grip site.

10. The control lever assembly of claim 8 wherein the arc of motion is oriented in a generally vertical plane.

11. The control lever assembly of claim 5 wherein the control lever is connected to a push-pull cable that controls a travel direction of the compaction roller.

12. The control lever assembly of claim 5 further comprising a button at a distal end of the control arm and connected to the control lever, the button being operable to disable rearward travel of the compaction roller when the button is actuated.

13. A method of forming a control arrangement for a walk behind compaction roller, the method comprising:

providing a control lever to define a first grip site and a second grip site that are laterally offset from another;

connecting the control lever to a control arm that is constructed to extend rearward from a compaction roller; and connecting a first control handle and a second control handle to the control arm so that the first control handle is proximate the first grip site and the second control handle is proximate the second grip site and so that the first and second control handles are oriented on opposite lateral sides of the control arm.

14. The method of claim 13 further comprising providing a grip knob of the control lever disposed between the first grip site and the second grip site.

15. The method of claim 13 further comprising connecting the control lever to a push-pull cable associated with the control arm.

16. The method of claim 13 wherein connecting the control lever to the control arm further comprises connecting the control lever to a pivot pin so that the control lever is pivotable relative to the control arm.

17. The method of claim 16 further comprising contouring the first control handle and the second control handle to have a curvilinear shaped portion that correlates to an arc defined by motion of the respective first and second grip sites of the control lever relative to the control arm.

18. A method of controlling a walk behind compaction roller, the compaction roller having at least one rotating drum, a frame supported on the drum, and a control arm extending rearwardly from the frame, the method comprising:

moving a control lever that defines a first grip site and a second grip site that are laterally offset from opposite sides of a longitudinal centerline of the control arm to control forward and rearward travel of the compaction roller;

concurrently grasping at least one of 1) the first grip site and a first control handle and 2) the second grip site and a second control handle to maintain a desired orientation of the control lever relative to the control arm; and imparting a lateral force to the control arm via the grasped at least one of the first control handle and the second control handle to turn the compaction roller.

19. The method of claim 18 further comprising grasping a knob of a control lever to maintain an orientation of the control lever relative to the control arm.

20. The method of claim 18 further comprising actuating a plunger to disable rearward travel of the compaction roller.

* * * * *